US012673808B2

(12) United States Patent
Zamora et al.

(10) Patent No.: US 12,673,808 B2
(45) Date of Patent: Jul. 7, 2026

(54) COMPOSTABLE SEALING MEMBER

(71) Applicant: Selig France, Chazay-d'Azergues (FR)

(72) Inventors: Rafael Zamora, Oberglatt (CH); Timea Cilmi, Oberglatt (CH)

(73) Assignee: SELIG FRANCE, Chazay-d'Azergues (FR)

( * ) Notice: Subject to any disclaimer, the term of this patent is extended or adjusted under 35 U.S.C. 154(b) by 323 days.

(21) Appl. No.: 18/282,731

(22) PCT Filed: Mar. 17, 2022

(86) PCT No.: PCT/US2022/020718
§ 371 (c)(1),
(2) Date: Sep. 18, 2023

(87) PCT Pub. No.: WO2022/197903
PCT Pub. Date: Sep. 22, 2022

(65) Prior Publication Data

US 2024/0174418 A1 May 30, 2024

Related U.S. Application Data

(60) Provisional application No. 63/163,139, filed on Mar. 19, 2021.

(51) Int. Cl.
*B65D 53/04* (2006.01)
*B65D 65/46* (2006.01)

(52) U.S. Cl.
CPC ..... *B65D 53/04* (2013.01); *B65D 65/466* (2013.01); *B65D 2251/20* (2013.01)

(58) Field of Classification Search
None
See application file for complete search history.

(56) References Cited

U.S. PATENT DOCUMENTS 1,818,379 A 8/1931 Cain
2,768,762 A 10/1956 Guinet
(Continued)

FOREIGN PATENT DOCUMENTS

AT 501393 A1 8/2006
AT 11738 U1 4/2011
(Continued)

OTHER PUBLICATIONS

Patent Cooperation Treaty, International Search Report and Written Opinion of the International Searching Authority dated Jun. 22, 2022 for International Application No. PCT/US2022/020718, 15 pages.

(Continued)

*Primary Examiner* — Ramsey Zacharia
(74) *Attorney, Agent, or Firm* — Fitch, Even, Tabin & Flannery, LLP

(57) ABSTRACT

Various forms of sealing members are described along with the laminates from which the sealing members are formed. In some forms, the sealing members may generally be formed from materials that may be compostable. In some forms, the sealing members are substantially free of plastic materials. In one form, the sealing members do not include any metal foil layers such as would traditionally be included in induction heated seals. Instead, the seals may be applied in other manners, such as using ultrasonic sealing, conduction heating, pressure sensitive adhesives, and the like.

17 Claims, 8 Drawing Sheets

(56) References Cited

U.S. PATENT DOCUMENTS

| | | | |
|---|---|---|---|
| 3,235,165 | A | 2/1966 | Jackson |
| 3,292,828 | A | 12/1966 | Stuart |
| 3,302,818 | A | 2/1967 | Balocca et al. |
| 3,460,310 | A | 8/1969 | Adcock et al. |
| 3,556,816 | A | 1/1971 | Nughes |
| 3,964,670 | A | 6/1976 | Amneus |
| 3,990,603 | A | 11/1976 | Brochman |
| 4,022,324 | A | 5/1977 | Schuster |
| 4,133,796 | A | 1/1979 | Bullman |
| 4,206,165 | A | 6/1980 | Dukess |
| 4,266,687 | A | 5/1981 | Cummings |
| 4,396,655 | A | 8/1983 | Graham |
| 4,556,590 | A | 12/1985 | Martin |
| 4,582,735 | A | 4/1986 | Smith |
| 4,588,099 | A | 5/1986 | Diez |
| 4,595,116 | A | 6/1986 | Carlsson |
| 4,596,338 | A | 6/1986 | Yousif |
| 4,636,273 | A | 1/1987 | Wolfersperger |
| 4,666,052 | A | 5/1987 | Ou-Yang |
| 4,693,390 | A | 9/1987 | Hekal |
| 4,735,335 | A | 4/1988 | Torterotot |
| 4,741,791 | A | 5/1988 | Howard |
| 4,762,246 | A | 8/1988 | Ashley |
| 4,770,325 | A | 9/1988 | Gordon |
| 4,771,903 | A | 9/1988 | Levene |
| 4,781,294 | A | 11/1988 | Croce |
| 4,784,885 | A | 11/1988 | Carespodi |
| 4,801,647 | A | 1/1989 | Wolfe, Jr. |
| 4,811,856 | A | 3/1989 | Fischman |
| 4,818,577 | A | 4/1989 | Ou-Yang |
| 4,837,061 | A | 6/1989 | Smits |
| 4,863,061 | A | 9/1989 | Moore |
| 4,867,881 | A | 9/1989 | Kinzer |
| 4,889,731 | A | 12/1989 | Williams |
| 4,917,949 | A | 4/1990 | Yousif |
| 4,934,544 | A | 6/1990 | Han |
| 4,938,390 | A | 7/1990 | Markva |
| 4,960,216 | A | 10/1990 | Giles |
| 4,961,986 | A | 10/1990 | Galda |
| 5,004,111 | A | 4/1991 | McCarthy |
| 5,012,946 | A | 5/1991 | McCarthy |
| 5,015,318 | A | 5/1991 | Smits |
| 5,053,457 | A | 10/1991 | Lee |
| 5,055,150 | A | 10/1991 | Rosenfeld |
| 5,057,365 | A | 10/1991 | Finkelstein |
| 5,071,710 | A | 12/1991 | Smits |
| 5,089,320 | A | 2/1992 | Straus |
| 5,098,495 | A | 3/1992 | Smits |
| RE33,893 | E | 4/1992 | Elias |
| 5,106,124 | A | 4/1992 | Volkman |
| 5,125,529 | A | 6/1992 | Torterotot |
| 5,131,556 | A | 7/1992 | Iioka |
| 5,149,386 | A | 9/1992 | Smits |
| 5,178,967 | A | 1/1993 | Rosenfeld |
| 5,197,618 | A | 3/1993 | Goth |
| 5,217,790 | A | 6/1993 | Galda |
| 5,226,281 | A | 7/1993 | Han |
| 5,261,990 | A | 11/1993 | Galda |
| 5,265,745 | A | 11/1993 | Pereyra |
| 5,433,992 | A | 7/1995 | Galda |
| 5,513,781 | A | 5/1996 | Ullrich |
| 5,514,442 | A | 5/1996 | Galda |
| 5,560,989 | A | 10/1996 | Han |
| 5,598,940 | A | 2/1997 | Finkelstein |
| 5,601,200 | A | 2/1997 | Finkelstein |
| 5,615,789 | A | 4/1997 | Finkelstein |
| 5,618,618 | A | 4/1997 | Murschall |
| 5,669,521 | A | 9/1997 | Wiening |
| 5,683,774 | A | 11/1997 | Faykish |
| 5,702,015 | A | 12/1997 | Giles |
| 5,709,310 | A | 1/1998 | Kretz |
| 5,720,401 | A | 2/1998 | Moore |
| 5,759,650 | A | 6/1998 | Raines |
| 5,776,284 | A | 7/1998 | Sykes |
| 5,851,333 | A | 12/1998 | Fagnant |
| 5,860,544 | A | 1/1999 | Brucker |
| 5,871,112 | A | 2/1999 | Giles |
| 5,887,747 | A | 3/1999 | Burklin |
| 5,915,577 | A | 6/1999 | Levine |
| 5,975,304 | A | 11/1999 | Cain |
| 5,976,294 | A | 11/1999 | Fagnant |
| 6,056,141 | A | 5/2000 | Navarini |
| 6,082,566 | A | 7/2000 | Yousif |
| 6,096,358 | A | 8/2000 | Murdick |
| 6,131,754 | A | 10/2000 | Smelko |
| 6,139,931 | A | 10/2000 | Finkelstein |
| 6,158,632 | A | 12/2000 | Ekkert |
| 6,194,042 | B1 | 2/2001 | Finkelstein |
| 6,234,386 | B1 | 5/2001 | Drummond |
| 6,290,801 | B1 | 9/2001 | Krampe |
| 6,312,776 | B1 | 11/2001 | Finkelstein |
| 6,361,856 | B1 | 3/2002 | Wakai |
| 6,378,715 | B1 | 4/2002 | Finkelstein |
| 6,458,302 | B1 | 10/2002 | Shifflet |
| 6,461,714 | B1 | 10/2002 | Giles |
| 6,544,615 | B2 | 4/2003 | Otten |
| 6,548,302 | B1 | 4/2003 | Mao |
| 6,602,309 | B2 | 8/2003 | Vizulis |
| 6,627,273 | B2 | 9/2003 | Wolf |
| 6,635,137 | B2 | 10/2003 | Giles |
| 6,669,046 | B1 | 12/2003 | Sawada |
| 6,699,566 | B2 | 3/2004 | Zeiter |
| 6,705,467 | B1 | 3/2004 | Kancsar |
| 6,722,272 | B2 | 4/2004 | Jud |
| 6,767,425 | B2 | 7/2004 | Meier |
| 6,790,508 | B2 | 9/2004 | Razeti |
| 6,866,926 | B1 | 3/2005 | Smelko |
| 6,902,075 | B2 | 6/2005 | Obrien |
| 6,916,516 | B1 | 7/2005 | Gerber |
| 6,955,736 | B2 | 10/2005 | Rosenberger |
| 6,959,832 | B1 | 11/2005 | Sawada |
| 6,974,045 | B1 | 12/2005 | Trombach |
| 6,986,930 | B2 | 1/2006 | Giles |
| 7,128,210 | B2 | 10/2006 | Razeti |
| 7,182,475 | B2 | 2/2007 | Kramer |
| 7,217,454 | B2 | 5/2007 | Smelko |
| RE39,790 | E | 8/2007 | Fuchs |
| 7,316,760 | B2 | 1/2008 | Nageli |
| 7,448,153 | B2 | 11/2008 | Maliner |
| 7,531,228 | B2 | 5/2009 | Perre |
| 7,648,764 | B2 | 1/2010 | Yousif |
| 7,713,605 | B2 | 5/2010 | Yousif |
| 7,731,048 | B2 | 6/2010 | Teixeira Alvares |
| 7,740,730 | B2 | 6/2010 | Schedl |
| 7,740,927 | B2 | 6/2010 | Yousif |
| 7,757,879 | B2 | 7/2010 | Schuetz |
| 7,789,262 | B2 | 9/2010 | Niederer |
| 7,798,359 | B1 | 9/2010 | Marsella |
| 7,819,266 | B2 | 10/2010 | Ross |
| 7,838,109 | B2 | 11/2010 | Declerck |
| 7,850,033 | B2 | 12/2010 | Thorstensen-Woll |
| 8,025,171 | B2 | 9/2011 | Cassol |
| 8,057,896 | B2 | 11/2011 | Smelko |
| 8,129,009 | B2 | 3/2012 | Morris |
| 8,201,385 | B2 | 6/2012 | Mclean |
| 8,308,003 | B2 | 11/2012 | O'brien |
| 8,329,288 | B2 | 12/2012 | Allegaert |
| 8,348,082 | B2 | 1/2013 | Cain |
| 8,455,071 | B2 | 6/2013 | Lo |
| 8,541,081 | B1 | 9/2013 | Ranganathan |
| 8,703,265 | B2 | 4/2014 | Thorstensen-Woll |
| 8,715,825 | B2 | 5/2014 | Thorstensen-Woll |
| 8,852,725 | B2 | 10/2014 | Sachs |
| 8,906,185 | B2 | 12/2014 | Mclean |
| 8,944,264 | B2 | 2/2015 | Frishman |
| 9,028,963 | B2 | 5/2015 | Thorstensen-Woll |
| 9,102,438 | B2 | 8/2015 | Thorstensen-Woll |
| 9,120,289 | B2 | 9/2015 | Chang |
| 9,132,947 | B2 | 9/2015 | Wiening |
| 9,193,513 | B2 | 11/2015 | Thorstensen-Woll |
| 9,221,579 | B2 | 12/2015 | Thorstensen-Woll |
| 9,227,755 | B2 | 1/2016 | Thorstensen-Woll |
| 9,278,506 | B2 | 3/2016 | Mclean |
| 9,278,793 | B2 | 3/2016 | Thorstensen-Woll |

(56) References Cited

U.S. PATENT DOCUMENTS 9,440,765 B2 9/2016 Thorstensen-Woll
9,440,766 B2 9/2016 Wiening
9,440,768 B2 9/2016 Thorstensen-Woll
9,533,805 B2 1/2017 Mclean
9,637,288 B2 5/2017 Abegglen
9,676,513 B2 6/2017 Thorstensen-Woll
9,834,339 B2 12/2017 Brucker
9,908,658 B2 3/2018 Jouin
9,956,741 B2 5/2018 Planchard
9,994,357 B2 6/2018 Thorstensen-Woll
10,000,310 B2 6/2018 Thorstensen-Woll
10,150,590 B2 12/2018 Thorstensen-Woll
10,196,174 B2 2/2019 Thorstensen-Woll
10,259,626 B2 4/2019 Thorstensen-Woll
10,549,510 B2 2/2020 Ettridge
10,556,732 B2 2/2020 Cassidy
10,604,315 B2 3/2020 Thorstensen-Woll
10,882,673 B2 1/2021 Shah
10,899,506 B2 1/2021 Thorstensen-Woll
10,934,069 B2 3/2021 Clark
10,954,032 B2 3/2021 Thorstensen-Woll
11,059,644 B2 7/2021 Cassidy
11,285,695 B2 3/2022 Brumbaugh
11,498,316 B2 11/2022 Dietrich
2001/0023870 A1 9/2001 Mihalov
2001/0026874 A1* 10/2001 Karhuketo ..... B32B 27/10 428/480
2001/0031348 A1 10/2001 Jud
2002/0028326 A1 3/2002 Lhila
2002/0068140 A1 6/2002 Finkelstein
2003/0087057 A1 5/2003 Blemberg
2003/0108714 A1 6/2003 Razeti
2003/0168423 A1 9/2003 Williams
2003/0196418 A1 10/2003 O'Brien
2004/0013862 A1 1/2004 Brebion
2004/0028851 A1 2/2004 Okhai
2004/0043165 A1 3/2004 Van Hulle
2004/0043238 A1 3/2004 Wuest
2004/0071934 A1 4/2004 Giles
2004/0109963 A1 6/2004 Zaggia
2004/0197500 A9 10/2004 Swoboda
2004/0211320 A1 10/2004 Cain
2005/0003155 A1 1/2005 Huffer
2005/0048307 A1 3/2005 Schubert
2005/0100718 A1 5/2005 Peiffer
2005/0208242 A1 9/2005 Smelko
2005/0208244 A1 9/2005 Delmas
2005/0218143 A1 10/2005 Niederer
2005/0279814 A1 12/2005 Drummond
2006/0000545 A1 1/2006 Nageli
2006/0003120 A1 1/2006 Nageli
2006/0003122 A1 1/2006 Nageli
2006/0068163 A1 3/2006 Giles
2006/0124577 A1 6/2006 Ross
2006/0151415 A1 7/2006 Smelko
2006/0278665 A1 12/2006 Bennett
2007/0003725 A1 1/2007 Yousif
2007/0007229 A1 1/2007 Yousif
2007/0014897 A1 1/2007 Ramesh
2007/0051690 A1 3/2007 Hidding
2007/0065609 A1 3/2007 Korson
2007/0267304 A1 11/2007 Portier
2007/0290012 A1 12/2007 Jackman
2007/0298273 A1 12/2007 Thies
2008/0026171 A1 1/2008 Gullick
2008/0073308 A1 3/2008 Yousif
2008/0103262 A1 5/2008 Haschke
2008/0135159 A1 6/2008 Bries
2008/0145581 A1 6/2008 Tanny
2008/0156443 A1 7/2008 Schaefer
2008/0169286 A1 7/2008 McLean
2008/0231922 A1 9/2008 Thorstensen-Woll
2008/0233339 A1 9/2008 Thorstensen-Woll
2008/0233424 A1 9/2008 Thorstensen-Woll
2008/0260305 A1 10/2008 Shah
2009/0078671 A1 3/2009 Triquet
2009/0208729 A1 8/2009 Allegaert
2009/0304964 A1 12/2009 Sachs
2010/0009162 A1 1/2010 Rothweiler
2010/0030180 A1 2/2010 Deckerck
2010/0047552 A1 2/2010 Mclean
2010/0059942 A1 3/2010 Rothweiler
2010/0089860 A1 4/2010 Wiggins
2010/0116410 A1 5/2010 Yousif
2010/0155288 A1 6/2010 Harper
2010/0170820 A1 7/2010 Leplatois
2010/0193463 A1 8/2010 Obrien
2010/0213193 A1 8/2010 Helmlinger
2010/0221483 A1 9/2010 Gonzalez Carro
2010/0279041 A1 11/2010 Mathew
2010/0290663 A1 11/2010 Trassl
2010/0314278 A1 12/2010 Fonteyne
2011/0000917 A1 1/2011 Wolters
2011/0005961 A1 1/2011 Leplatois
2011/0049002 A1 3/2011 Georgelos
2011/0089177 A1 4/2011 Thorstensen-Woll
2011/0091715 A1 4/2011 Rakutt
2011/0100949 A1 5/2011 Grayer
2011/0100989 A1 5/2011 Cain
2011/0138742 A1 6/2011 Mclean
2011/0147353 A1 6/2011 Kornfeld
2011/0152821 A1 6/2011 Kornfeld
2012/0000910 A1 1/2012 Ekkert
2012/0043330 A1 2/2012 Mclean
2012/0067896 A1 3/2012 Daffner
2012/0070636 A1 3/2012 Thorstensen-Woll
2012/0077029 A1 3/2012 Troutman
2012/0103988 A1 5/2012 Wiening
2012/0111758 A1 5/2012 Lo
2012/0241449 A1 9/2012 Frischmann
2012/0241458 A1 9/2012 Boiron
2012/0279973 A1 11/2012 Capitani
2012/0285920 A1 11/2012 Mclean
2012/0288693 A1 11/2012 Stanley
2012/0312818 A1 12/2012 Ekkert
2013/0020324 A1 1/2013 Thorstensen-Woll
2013/0020328 A1 1/2013 Duan
2013/0045376 A1 2/2013 Chen
2013/0121623 A1 5/2013 Lyzenga
2013/0177263 A1 7/2013 Duan
2013/0248410 A9 9/2013 Spallek
2014/0001185 A1 1/2014 Mclean
2014/0037916 A1 2/2014 Reilly
2014/0037940 A1 2/2014 Tetsuo
2014/0061196 A1 3/2014 Thorstensen-Woll
2014/0061197 A1 3/2014 Thorstensen-Woll
2014/0186589 A1 7/2014 Chang
2014/0224800 A1 8/2014 Thorstensen-Woll
2014/0284331 A1 9/2014 Thorstensen-Woll
2014/0326727 A1 11/2014 Jouin
2015/0053680 A1 2/2015 Yuno
2015/0083723 A1 3/2015 Thorstensen-Woll
2015/0131926 A1 5/2015 Lux
2015/0158643 A1 6/2015 Coker
2015/0197385 A1 7/2015 Wei
2015/0225116 A1 8/2015 Thorstensen-Woll
2015/0291342 A1 10/2015 Mack
2015/0321808 A1 11/2015 Thorstensen-Woll
2016/0001952 A1 1/2016 Kulkarni
2016/0159541 A1 6/2016 Brandl
2016/0159546 A1 6/2016 Cassidy
2016/0185485 A1 6/2016 Thorstensen-Woll
2016/0325896 A1 11/2016 Thorstensen-Woll
2017/0002238 A1* 1/2017 Ihrig ..... C08G 18/4238
2017/0173930 A1 6/2017 Mclean
2017/0253373 A1 9/2017 Thorstensen-Woll
2017/0259978 A1 9/2017 Zamora
2017/0291399 A1 10/2017 Bourgeois
2017/0361638 A1 12/2017 Seth
2018/0079576 A1 3/2018 Cassidy
2018/0118439 A1 5/2018 Thorstensen-Woll
2018/0186122 A1 7/2018 Bourgeois
2019/0055070 A1 2/2019 Brown
2019/0092520 A1 3/2019 Thorstensen-Woll

(56) References Cited

U.S. PATENT DOCUMENTS

| | | | | |
|---|---|---|---|---|
| 2019/0225369 | A1 | 7/2019 | Thorstensen-Woll | |
| 2019/0270547 | A1 | 9/2019 | Thorstensen-Woll | |
| 2019/0276209 | A1 | 9/2019 | Clark | |
| 2020/0079561 | A1 | 3/2020 | Zamora | |
| 2020/0087056 | A1 | 3/2020 | Bosetti | |
| 2020/0108987 | A1 | 4/2020 | De La Vega Sudan | |
| 2020/0216256 | A1 | 7/2020 | Miozzo | |
| 2020/0277121 | A1 | 9/2020 | Wei | |
| 2020/0282708 | A1 | 9/2020 | Leuer | |
| 2021/0188489 | A1 | 6/2021 | Thorstensen-Woll | |
| 2021/0237951 | A1 | 8/2021 | Ostergren | |
| 2021/0292059 | A1 | 9/2021 | Thorstensen-Woll | |
| 2021/0292060 | A1 | 9/2021 | Thorstensen-Woll | |
| 2022/0152999 | A1 | 5/2022 | Priscal | |
| 2022/0194681 | A1 | 6/2022 | Schell | |
| 2022/0227554 | A1 | 7/2022 | Lehrter | |
| 2022/0274759 | A1 | 9/2022 | Wegenberger | |
| 2022/0355574 | A1 | 11/2022 | Yee | |
| 2022/0410545 | A1 | 12/2022 | Thorstensen-Woll | |
| 2022/0411146 | A1 | 12/2022 | Sachs | |
| 2023/0088010 | A1 | 3/2023 | Francklow | |
| 2023/0094210 | A1 | 3/2023 | Zamora | |
| 2023/0182457 | A1 | 6/2023 | Utz | |
| 2023/0226797 | A1 | 7/2023 | Thorstensen-Woll | |
| 2023/0287626 | A1* | 9/2023 | Tsunoda | D21H 19/60 |

FOREIGN PATENT DOCUMENTS

| | | | |
|---|---|---|---|
| AU | 2021328601 | A1 | 3/2023 |
| BR | 8200231 | U | 9/2003 |
| BR | 0300992 | A | 11/2004 |
| CA | 2015992 | A1 | 1/1991 |
| CA | 2203744 | A1 | 10/1997 |
| CA | 2297840 | A1 | 2/1999 |
| CN | 1301289 | A | 6/2001 |
| CN | 1639020 | A | 7/2005 |
| CN | 101111437 | A | 1/2008 |
| CN | 103193026 | A | 7/2013 |
| CN | 104203765 | A | 12/2014 |
| CN | 104755387 | A | 7/2015 |
| CN | 104755388 | A | 7/2015 |
| CN | 104853994 | A | 8/2015 |
| CN | 106687386 | A | 5/2017 |
| CN | 108238366 | A | 7/2018 |
| CN | 108473247 | A | 8/2018 |
| CN | 108481851 | A | 9/2018 |
| CN | 108883602 | A | 11/2018 |
| CN | 208070440 | U | 11/2018 |
| CN | 109863021 | A | 6/2019 |
| CN | 210794267 | U | 6/2020 |
| CN | 211077015 | U | 7/2020 |
| CN | 111605889 | A | 9/2020 |
| CN | 113423649 | A | 9/2021 |
| CN | 115179627 | A | 10/2022 |
| DE | 102006030118 | B3 | 5/2007 |
| DE | 10204281 | A1 | 8/2007 |
| DE | 102007022935 | B4 | 4/2009 |
| DE | 202009000245 | U1 | 4/2009 |
| DE | 102013015581 | B3 | 10/2014 |
| DE | 102020131929 | A1 | 6/2022 |
| DE | 102020133989 | A1 | 6/2022 |
| EP | 0135431 | A1 | 3/1985 |
| EP | 0577432 | A1 | 1/1994 |
| EP | 0668221 | A1 | 8/1995 |
| EP | 0826598 | A2 | 3/1998 |
| EP | 0826599 | A2 | 3/1998 |
| EP | 0905039 | A1 | 3/1999 |
| EP | 0717710 | B1 | 4/1999 |
| EP | 0915026 | A1 | 5/1999 |
| EP | 0706473 | B1 | 8/1999 |
| EP | 1075921 | A2 | 2/2001 |
| EP | 1199253 | A2 | 4/2002 |
| EP | 0803445 | B1 | 11/2003 |
| EP | 1462381 | A1 | 9/2004 |
| EP | 1199253 | B1 | 3/2005 |
| EP | 1577226 | A1 | 9/2005 |
| EP | 1814744 | A1 | 8/2007 |
| EP | 1834893 | A1 | 9/2007 |
| EP | 1837288 | A1 | 9/2007 |
| EP | 1839898 | A1 | 10/2007 |
| EP | 1839899 | A1 | 10/2007 |
| EP | 1857275 | A1 | 11/2007 |
| EP | 1873078 | A1 | 1/2008 |
| EP | 1445209 | B1 | 5/2008 |
| EP | 1918094 | A1 | 5/2008 |
| EP | 1935636 | A1 | 6/2008 |
| EP | 1968020 | A1 | 9/2008 |
| EP | 1992476 | A1 | 11/2008 |
| EP | 2014461 | A1 | 1/2009 |
| EP | 2230190 | | 9/2010 |
| EP | 2230190 | A1 | 9/2010 |
| EP | 2292524 | A1 | 3/2011 |
| EP | 2599735 | A1 | 6/2013 |
| EP | 2230190 | B1 | 8/2014 |
| EP | 2778090 | A1 | 9/2014 |
| EP | 3587297 | A1 | 1/2020 |
| EP | 3615325 | A1 | 3/2020 |
| EP | 3278972 | B1 | 10/2020 |
| EP | 3829869 | A2 | 6/2021 |
| EP | 3887275 | A1 | 10/2021 |
| EP | 3898219 | A1 | 10/2021 |
| EP | 3946936 | A1 | 2/2022 |
| EP | 3969276 | A1 | 3/2022 |
| EP | 3986711 | A1 | 4/2022 |
| EP | 3995307 | A1 | 5/2022 |
| EP | 3997268 | A1 | 5/2022 |
| EP | 4038131 | A1 | 8/2022 |
| EP | 4151549 | A1 | 3/2023 |
| EP | 4161777 | A1 | 4/2023 |
| EP | 4194361 | A1 | 6/2023 |
| FR | 2693986 | A1 | 1/1994 |
| FR | 2916157 | A1 | 11/2008 |
| FR | 2943322 | A1 | 9/2010 |
| GB | 1216991 | A | 12/1970 |
| GB | 2353986 | A | 3/2001 |
| GB | 2501967 | A | 11/2013 |
| JP | H02265735 | A | 10/1990 |
| JP | H09110077 | A | 4/1997 |
| JP | 2004212778 | A | 7/2004 |
| JP | 2014015249 | | 1/2014 |
| KR | 100711073 | B1 | 4/2007 |
| KR | 100840926 | B1 | 6/2008 |
| KR | 100886955 | B1 | 3/2009 |
| KR | 102501281 | B1 | 2/2023 |
| MX | 05002905 | A | 2/2006 |
| MX | 2010001867 | A | 4/2010 |
| TW | 201217237 | A | 5/2012 |
| WO | 9702997 | A1 | 1/1997 |
| WO | 9905041 | A1 | 2/1999 |
| WO | 0066450 | A1 | 11/2000 |
| WO | 03101500 | A1 | 12/2003 |
| WO | 2005009868 | A1 | 2/2005 |
| WO | 2005030860 | A1 | 4/2005 |
| WO | 2005049319 | A1 | 6/2005 |
| WO | 2006018556 | A1 | 2/2006 |
| WO | 2006021291 | A1 | 3/2006 |
| WO | 2006073777 | A1 | 7/2006 |
| WO | 2006108853 | A1 | 10/2006 |
| WO | 2008027029 | A2 | 3/2008 |
| WO | 2008027036 | A1 | 3/2008 |
| WO | 2008039350 | A2 | 4/2008 |
| WO | 2008113855 | A1 | 9/2008 |
| WO | 2008118569 | A2 | 10/2008 |
| WO | 2008125784 | A1 | 10/2008 |
| WO | 2008125785 | A1 | 10/2008 |
| WO | 2008148176 | A1 | 12/2008 |
| WO | 2009092066 | A2 | 7/2009 |
| WO | 2010115811 | A1 | 10/2010 |
| WO | 2011039067 | A1 | 4/2011 |
| WO | 2012079971 | A1 | 6/2012 |
| WO | 2012113530 | A1 | 8/2012 |
| WO | 2012152622 | A1 | 11/2012 |
| WO | 2012172029 | A1 | 12/2012 |
| WO | 2013134665 | A1 | 9/2013 |

(56) References Cited

FOREIGN PATENT DOCUMENTS

| | | | |
|---|---|---|---|
| WO | 2014190395 | A1 | 12/2014 |
| WO | 2015119988 | A1 | 8/2015 |
| WO | 2016118579 | A1 | 7/2016 |
| WO | 2016203251 | A1 | 12/2016 |
| WO | 2017155946 | A1 | 9/2017 |
| WO | 2017187024 | A1 | 11/2017 |
| WO | 2018081419 | | 5/2018 |
| WO | 2018081533 | A1 | 5/2018 |
| WO | 2019149558 | A1 | 8/2019 |

OTHER PUBLICATIONS

European Patent Office, Extended European Search Report dated Jul. 11, 2024 for European Patent Application No. 22772192.5, 8 pages.

* cited by examiner

COMPOSTABLE SEALING MEMBER

CROSS-REFERENCE TO RELATED APPLICATIONS

This application is a U.S. national phase application filed under 35 U.S.C. § 371 of International Application Number PCT/US2022/020718, filed Mar. 17, 2022, designating the United States, which claims benefit of U.S. Provisional Application No. 63/163,139, filed Mar. 19, 2021, which are hereby incorporated herein by reference in their entirety.

FIELD

The disclosure relates to sealing members for sealing the mouth of a container, and more particularly, to sealing members that are compostable.

BACKGROUND

It is often desirable to seal the opening of a container using a removable or peelable seal, sealing member, or inner seal. Often a cap or other closure is then screwed or placed over the container opening capturing the sealing member therein. In use, a consumer typically removes the cap or other closure to gain access to the sealing member and then removes or otherwise peels the seal from the container in order to dispense or gain access to its contents.

Initial attempts at sealing a container opening utilized an induction- or conduction-type inner seal covering the container's opening where the seal generally conformed to the shape of the opening such that a circular container opening was sealed with a round disk approximately the same size as the opening. These prior seals commonly had a lower heat activated sealing layer to secure a periphery of the seal to a rim or other upper surface surrounding the container's opening. Upon exposing the seal to heat, the lower layer bonded to the container's rim. In many cases, these seals included a foil layer capable of forming induction heat to activate the lower heat seal layer. These prior seals tended to provide good sealing, but were often difficult for a consumer to remove because there was nothing for the consumer to grab onto in order to remove the seal. Often, the consumer needed to pick at the seal's edge with a fingernail because there was little or no seal material to grasp.

Other types of seals for containers include a side tab or other flange that extended outwardly from a peripheral edge of the seal. These side tabs are generally not secured to the container rim and provide a grasping surface for a consumer to hold and peel off the seal.

Yet other types of seals include a sealing member having a tab defined on the top of the seal. One approach of these prior seals includes a partial layer of coated pressure sensitive adhesive to secure the tab to a layer of metal foil. The tab was formed by a full layer extending across the entire surface of the sealing member, but the full layer was only bonded to half of the seal to form the tab. This type of top-tabbed seal offered the advantage of a larger tab, which provided more grasping area for the consumer to hold and peel off the seal, but required a full additional layer of material in order to form the tab. In other approaches, the seal may include a tab formed from the additional full layer of film combined with an additional full layer of adhesive utilizing a part paper or part polymer layer, called a tab stock, to form the tab. This part layer is inserted between the additional full layer of adhesive and lower seal portions to prevent the tab from sticking to the layers below, which formed the tab.

However, oftentimes such sealing members are induction sealed to the container, thereby requiring an induction heating layer, such as a metal foil. Such metal foils complicate recycling or composting efforts as the metal foil would need to be separated from the sealing member. Further, in some instances, a portion of the metal foil may remain on the container, thereby complicating recycling the container itself.

Further, many conventional sealing members typically included one or more plastic material film layers. For example, polypropylene, polyethylene, and the like are included in one or more layers of the upper and/or lower laminates. However, when these and other similar plastic materials are included in the sealing members, the resulting laminate is no longer compostable or as readily compostable as may be desired. Therefore, it may be desirable to provide tabbed sealing members that are more suited for composting, such as providing sealing members that do not include metal foils and/or plastic layers.

SUMMARY

Various forms of compostable sealing members are described along with the laminates from which the sealing members are formed. In some forms, the compostable sealing members may generally be formed from materials that may be easily composted and otherwise are substantially free from layers and materials that are not compostable. In one form, the sealing members do not include any metal foils, such as would traditionally be included in induction heated seals. Instead, the seals may be applied in other manners, such as using ultrasonic sealing, high frequency sealing, conduction heating, pressure sensitive adhesives, and the like. Further, in some forms, the sealing members are substantially free of plastic films and materials.

According to one form, a sealing member for sealing to a rim surrounding a container opening is provided. The sealing member includes a multi-layer laminate including an upper laminate portion bonded to a lower laminate portion. The lower laminate portion is positioned below the upper laminate portion and includes at least one film layer and a sealant layer for bonding to the container rim. The upper laminate portion includes a support layer. Further, the compostable sealing member is substantially free of a plastic materials.

In accordance with one form, a laminate for forming a compostable sealing member is provided. The laminate includes an upper laminate portion bonded to a lower laminate portion. The upper laminate portion includes a support layer. The lower laminate portion includes at least one film layer and a sealant layer for bonding to the container rim. The upper laminate portion is bonded to a lower laminate portion. The laminate is substantially free of plastic materials.

In one form, a method for sealing a container is provided. The method includes the steps of: providing a compostable sealing member, applying the compostable sealing member to a rim of the container, and providing heat to at least one of the compostable sealing member and the container to adhere the sealant layer to the container rim. The compostable sealing member includes a multi-layer laminate including an upper laminate portion bonded to a lower laminate portion. The lower laminate portion includes at least one film layer and a sealant layer. The upper laminate portion includes a support layer. The compostable sealing member is substantially free of a plastic materials.

In accordance with one form, the sealing member contains less than 5 wt. % plastic materials. In some forms, the sealing member contains less than 3 wt. %, and in some forms, less than 1 wt. % plastic.

According to one form, the sealing member contains less than 5 wt. % non-compostable materials. Additionally, or alternatively, the sealing member contains less than 3 wt. %, less than 2 wt. %, or less than 1 wt. % non-compostable materials.

In one form, the sealing member contains less than 2 wt. % of a single non-compostable material. In some forms, the sealing member contains less than 1 wt. % of a single non-compostable material.

In accordance with one form, the sealing member is free of metal foil.

According to one form, the at least one film layer comprises at least one of cellulose film, a compostable adhesive, and combinations thereof.

In one form, the compostable sealing member further comprises a compostable adhesive. In some forms, the compostable adhesive comprises at least one of compostable polyurethane materials and combinations thereof. Exemplary forms include, but are not limited to, MS 255 Eco+ CS-95 by Morchem. It should be appreciated that non-compostable adhesives can be used so long as the overall composition of the sealing member does not exceed the non-compostable thresholds.

In accordance with one form, the lower laminate portion further includes a sacrificial layer between the at least one film layer and the sealant layer.

According to one form, at least one of the sealant layer and the sacrificial layer is primarily positioned over the rim area when installed on the container.

In one form, the upper laminate portion is partially bonded to the lower laminate portion to form a gripping tab for removing the sealing member from the container opening.

In accordance with one form, the gripping tab is defined wholly within a perimeter of the sealing member without extending substantially beyond the rim of the container.

According to one form, the gripping tab extends external to the rim when installed on the container.

In one form, the sealant layer is a pressure sensitive adhesive.

In accordance with one form, the upper laminate portion includes a print layer.

These and other aspects may be understood more readily from the following description and the appended drawings.

DETAILED DESCRIPTION

Figure 1:
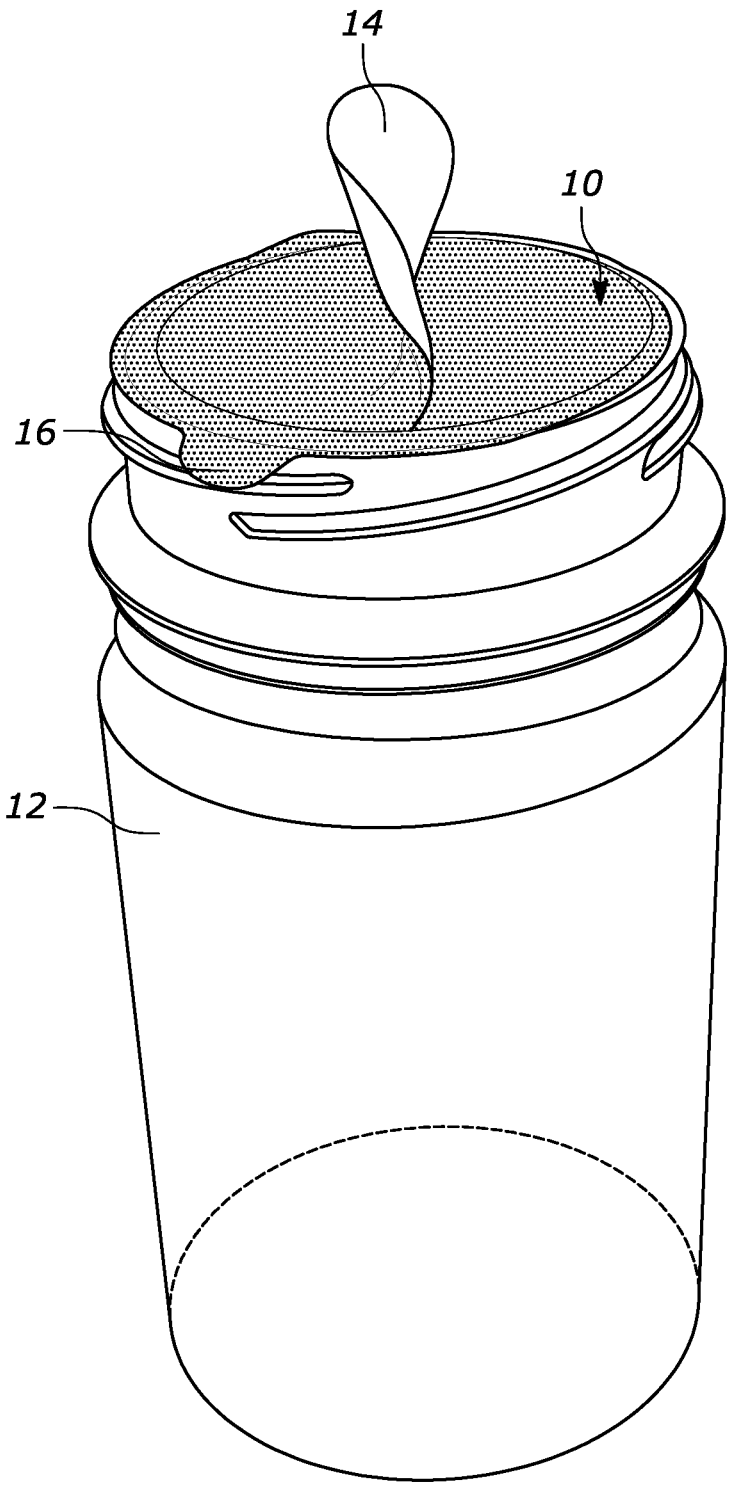
FIG. 1 is a perspective view of one form of a compostable sealing member affixed to a container.

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

A sealing member for a container is described herein containing an upper laminate portion bonded to a lower laminate portion capable of being sealed to a container's mouth or opening. Generally, the sealing member is compostable. In this regard, the sealing member includes less than 5 wt. %, non-compostable materials. In some forms, less than 2 wt. %, and in other forms, less than 1 wt. % non-compostable materials. In some forms, the sealing member is free of metal foil layers. However, it should be appreciated that the sealing member may include one or metallized layers for barrier properties, but the metallized portion is relatively minor compared to the layer and the remainder of the sealing member. It should also be appreciated that the sealing member may include non-compostable components, such as non-compostable adhesives, metallized layers, metallized coatings, plastic coatings, and the like so long as the overall composition does not exceed the non-compostable thresholds.

In some forms, the sealing member is substantially free of non-compostable plastic materials. In some forms, the sealing member includes less than 5 wt. %, non-compostable plastic materials. In some forms, the sealing member contains less than 2 wt. %, and in other forms, less than 1 wt. % non-compostable plastic materials.

In some forms, the sealing member may also be free from metal foil, such as aluminum foil, that would typically be used to induction seal to a container. Instead, many of the forms described herein may use alternative sealing technology, such as conduction heating, ultrasonic sealing, high frequency sealing, pressure sensitive adhesives, and the like.

For simplicity, this disclosure generally may refer to a container or bottle, but the sealing members herein may be applied to any type of container, bottle, package or other apparatus having a rim or mouth surrounding an access opening to an internal cavity. In this disclosure, reference to upper and lower surfaces and layers of the components of the sealing member refers to an orientation of the components as generally depicted in figures and when the sealing member is in use with a container in an upright position and having an opening at the top of the container. Different approaches to the sealing member will first be generally described, and then more specifics of the various constructions and materials will be explained thereafter. It will be appreciated that the sealing members described herein, in some cases, function in both a one-piece or two-piece sealing member configuration. A one-piece sealing member generally includes just the sealing member bonded to a container rim. A cap or closure may be also used therewith. A two-piece sealing member includes the sealing member temporarily bonded to a liner. In this construction, the sealing member is bonded to a container's rim, and the liner is configured to separate from the sealing member during heating to be retained in a cap or other closure used on the container. Alternatively, the bond between the liner and the sealing member may be frangible such that it separates when the lid is removed from the container by a user. In a two-piece construction, a wax layer, for example, may be used to temporarily bond the sealing member to a liner. Other types of releasable layers may also be used to provide a temporary bond between the seal and liner.

Figure 3:
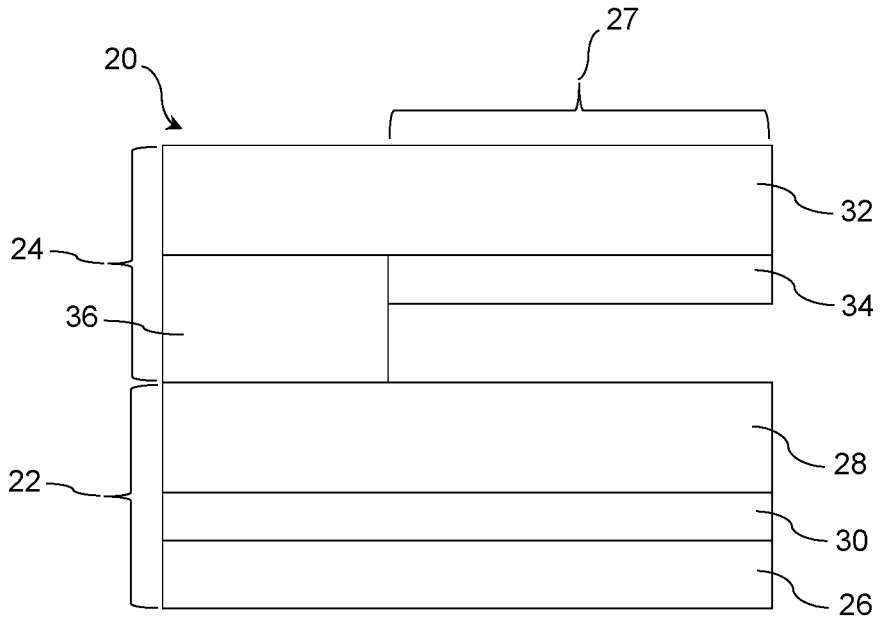
FIG. 3 is a cross-sectional view of another form of a tabbed sealing member that does not include a metal foil layer.

Further, the sealing members described herein may have no tab, may have a top tab, and/or may have an externally extending tab. In the forms where no tab is provided, the sealing member does not have a graspable tab at the top of the sealing member and otherwise does not have large, outwardly extending tab from the rim of the container when installed. Instead, at most, the non-tabbed versions may have a very small amount of material that slightly extends over the edge of the rim of the container and may be engaged by a user's fingernail. In some forms, the non-tabbed versions have no material extending beyond the rim of the container. In top tab versions, the top tab is formed by at least a portion of the upper laminate such that the top tab may be grasped by the user above the sealing member. In some forms, the top tab versions have tabs that do not extend substantially beyond the rim of the container when installed. Examples of such top tab structures and positioning may be found in U.S. Pat. No. 9,028,963, such as shown in FIG. 3. External tab forms generally have tabs that extend outwardly beyond the rim of the container. With circular sealing members, external tab forms generally have a protrusion that extends outwardly beyond the circumference of the sealing member.

The tabbed compostable sealing members described herein, in some forms, may be prepared such that they do not require a specific tab layer, such as a PET layer, as used in many traditional tabbed seals. This can help keep the sealing members compostable by eliminating PET layers that traditionally are included in the tabs.

Similarly, in some forms, PET layers can be eliminated from the upper laminate portion, as desired. Instead, PET layers in the upper laminate portion can be replaced with other materials, such compostable materials, as described below. This can help improve the compostability of the tabbed sealing member.

As discussed above, tabbed seals can suffer from problems associated with the use of metal foils and/or plastic materials in the tabbed sealing member. This can result in a combination of metal and polymer in the removed sealing member as well as remnant metal and polymer on the container once the sealing member is removed. These combinations of materials can lead to difficulties for recycling.

One form of a compostable sealing member is shown in FIG. 1. Sealing member 10 is shown in a sealed configuration on a container 12. Sealing member 10 is shown having both a top tab 14 and an externally extending tab 16. One or more of these tab configurations can be used in any of the embodiments described herein. Further, it should be appreciated that in some forms, both tab configurations may be used or a single form of the tab configurations may be used.

Figure 2:
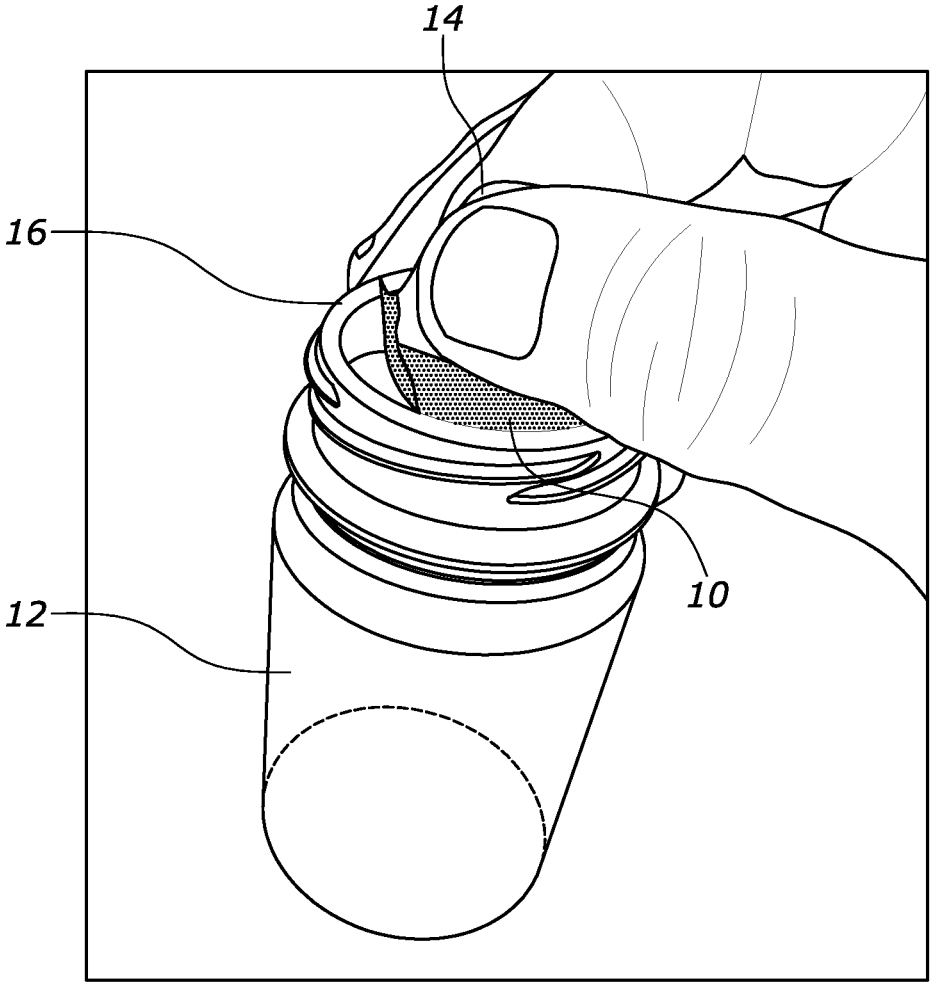
FIG. 2 is a perspective view of the compostable sealing member of FIG. 1 as it is being removed from the container.

As shown in FIG. 2, the sealing member 10 is being removed from the container 12 via the tab 14. The sealing member 10 may alternatively be removed using tab 16. Further, in some forms, all layers of the sealing member 10 are removed from the container 12 as the sealing member 10 is removed. In other forms, a portion of a layer of the sealing member 10 may remain on the container as a remnant 18, as will be discussed in more detail below. The remnant 18 may include sealing materials, sacrificial layers, and the like, which may permit easier removal from the container 12.

Details regarding various configurations of compostable sealing members will now be discuss in more detail. More specifically, FIG. 3 is a cross-section of compostable tabbed sealing member 20 which is a multi-layer laminate. The sealing member 20 includes a lower laminate portion 22 partially bonded to an upper laminate portion 24. A tab 27 is thereby formed for a user to grasp. In this form, the tab 27 is wholly within the perimeter of the sealing member. The lower laminate portion 22 includes a sealant layer 26 for bonding to a container rim and a film layer 28. As shown in FIG. 3, the sealing member 20 may also include an additional layer 30, such as an intermediate layer. Additional layer 30 may provide for a variety of functions, such as improving adhesion between the sealant layer 26 and the film layer 28, acting as a sacrificial layer that ruptures or separates during seal removal, providing additional thickness or support, as well as other features. Additional layer 30, if included, may also be positioned elsewhere in the structure.

The upper laminate portion 24 includes a support layer 32. The upper laminate portion 24 is shown in FIG. 3 including optional print layer 34. Adhesive layer 36 is shown as forming a bond between the lower and upper laminate portions 22,24 and is positioned in the upper laminate portion 24. However, it should be appreciated that the adhesive layer 36 may alternatively be provided in the lower laminate portion 22. Additional layers may also be included in the upper laminate portion 24, such as a tab layer, a release layer, additional support layers, and the like.

Figure 4:
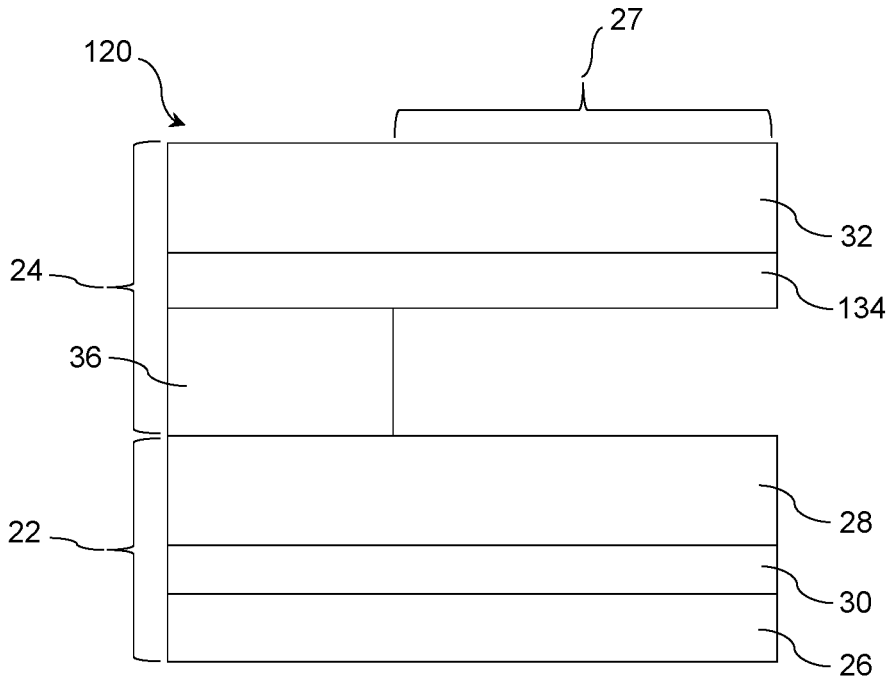
FIG. 4 is a cross-sectional view of one form of a tabbed sealing member that includes a full printed layer.

As shown in FIG. 3, the print layer 34 is a partial layer. In the form shown in FIG. 4, print layer 134 extends substantially across the entire surface area of sealing member 120. In addition to and/or instead of print layer 134, additional film layers, support layers, membrane layers, and the like may be included in the upper laminate portion 24 and extend partially or substantially across the entire surface area.

Figure 5:
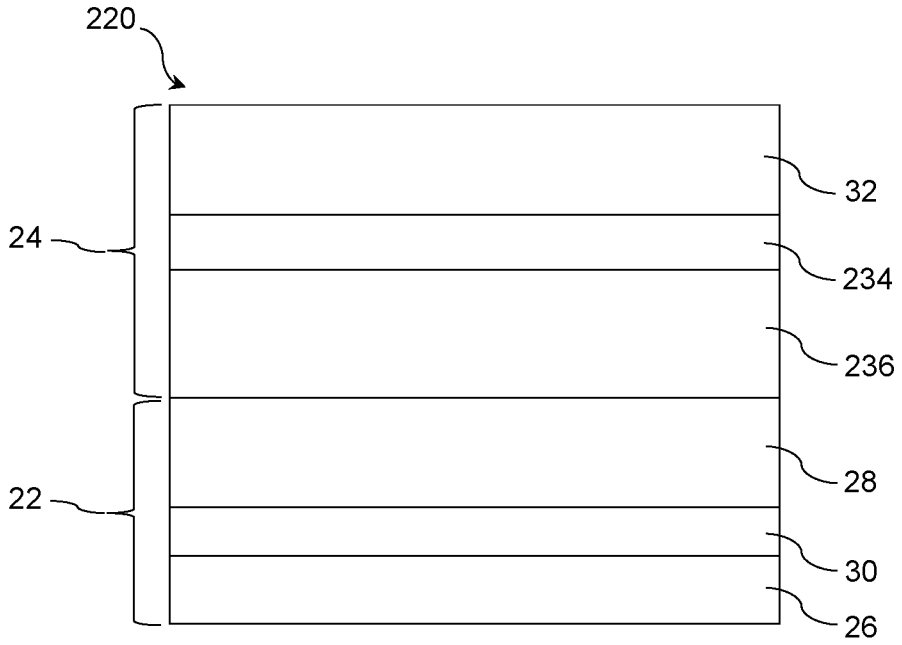
FIG. 5 is a cross-sectional view of one form of a sealing member that does not include a tab.

Yet another form is shown in FIG. 5. In this form, sealing member 220 includes an adhesive layer 236 that extends across substantially the entire surface area of the sealing member 220. In this form, a top tab would not be formed. However, the sealing member 220 could be tab free or otherwise include an external tab, as described above. Sealing member 220 may also include an additional layer 234 that extends across substantially the entire surface area. The additional layer 234 can be the same or similar to layers described above, such as a film layer, support layer, membrane layer, print layer, and the like.

Figure 6:
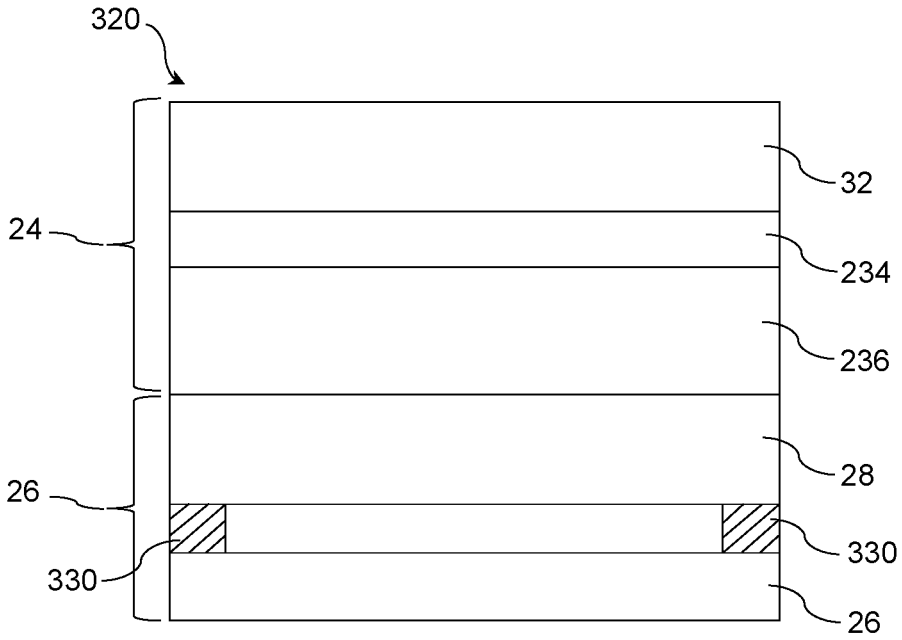
FIG. 6 is a cross-sectional view of one form of a sealing member having a sacrificial layer positioned only over the container land area.

Turning now to FIG. 6, in this form, sealing member 320 includes an additional layer 330 that is a partial layer. More specifically, additional layer 330 is positioned so that is generally is above the land area of the container when the sealing member 320 is installed. In this form, the amount of material used for additional layer 330 can be decreased. Further, additional layer may take the form of a sacrificial layer such that it ruptures or otherwise releases from one of the sealant layer 26 and the film layer 28. In this regard, a portion of the sealant layer 26 and or the additional layer 330 may remain as a remnant on the container after the sealing member 320 is removed. Similarly, the sealant layer 26 may take the form of a partial layer that is generally just positioned over the land area of the container rim. In this form, the amount of material used for the sealant layer 26 may be decreased.

Figure 7:
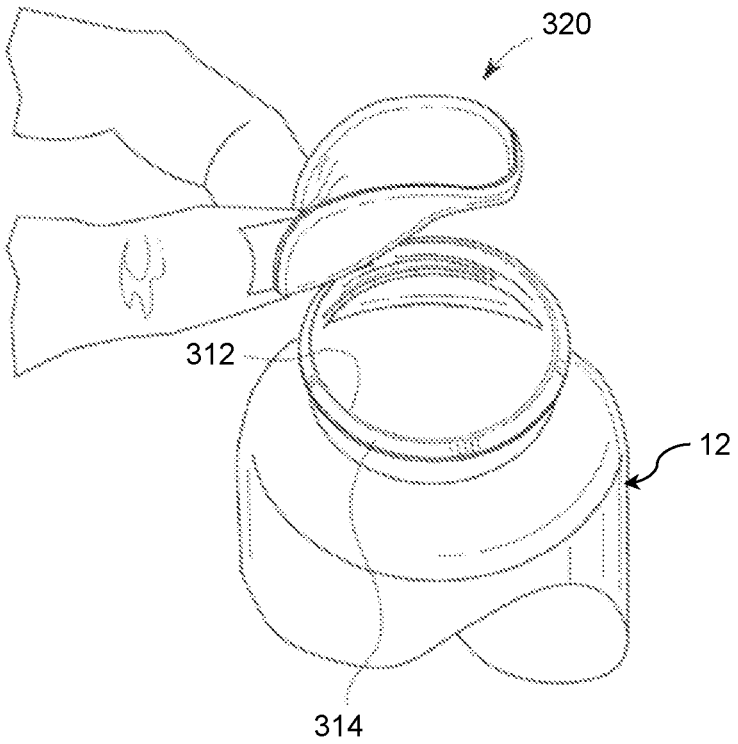
FIG. 7 is a perspective view of one form of a tabbed sealing member being removed from a container.

FIG. 7 illustrates one form of sealing member 320 being removed form a container 12. Sealing member 320 includes a partial additional layer 330, as shown in FIG. 6, where the additional layer 320 is a sacrificial layer and is generally positioned just over land area 312 of the container 12. In this form, when the sealing member 320 is removed from the container 12, a remnant portion 314 remains on the land area 312. The remnant portion 314 includes at least a portion of the sealant layer 26. The remnant portion 314 may also include at least a portion of the additional layer 320.

Figure 8:
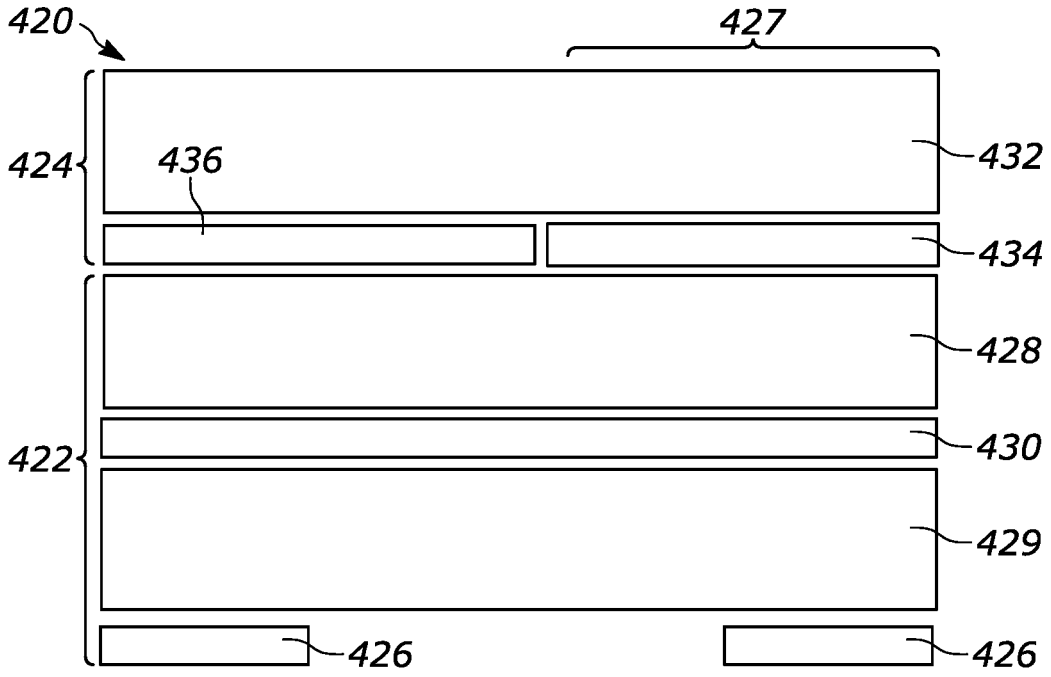
FIG. 8 is a cross-sectional view of one form of a sealing member having a partial sealant layer positioned such that it will be adjacent the land area of a container.

FIG. 8 depicts one form of a sealing member 420 having a lower laminate portion 422 partially bonded to an upper laminate portion 424. A tab 427 is formed at the unbonded portion. The lower laminate portion 422 includes a sealant layer 426 that does not extend the entire surface area of the sealing member 420. Instead, sealant layer 426 is positioned such that it is substantially above the land are when installed on a rim of a container. In other words, sealant layer 426 is circular and generally positioned just near the edge of the sealing member. In one form, the sealant layer 426 is a PET heatseal.

The lower laminate portion 422 also includes film layer 428, which in one form, is a 45 micron metallized cellulose layer. The lower laminate may also include an additional layer 429. In one form, additional layer 429 is a 45 micron cellulose film layer that is transparent. Film layer 428 is adhered to the additional layer 429 via a compostable adhesive 430.

Upper laminate portion 424 includes a support layer 432 as well as ink layer 434. The support layer 432 may be a 45 micron transparent cellulose film. Compostable adhesive 436 is partially applied to permit the free portion forming the tab 427.

Figure 9:
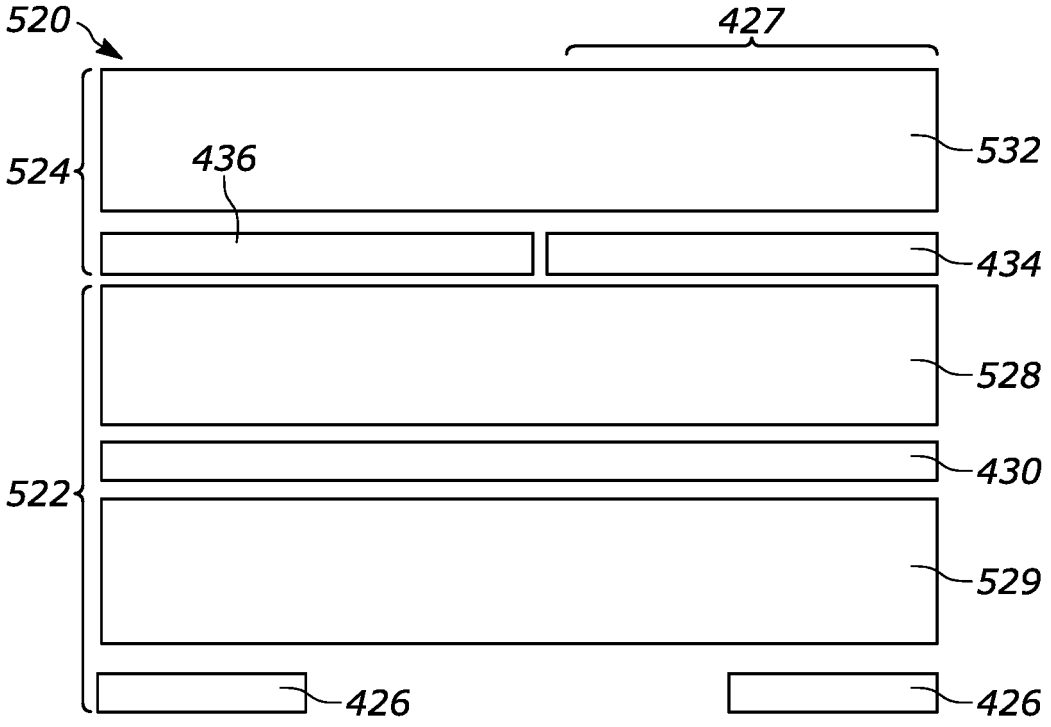
FIG. 9 is a cross-sectional view of another form of a sealing member having a partial sealant layer positioned such that it will be adjacent the land area of a container.

FIG. 9 is similar to the embodiment shown in FIG. 8. Similar components will be given the same numbers as in FIG. 8 and will not be discussed in detail. Sealing member 520 includes a lower laminate portion 522 and an upper laminate portion 524. The lower laminate portion 522 includes a film layer 528 such as a 30 micron metallized cellulose film. The lower laminate portion 522 also includes an additional layer 529 such as a 30 micron transparent cellulose film. Further, the upper laminate portion includes a support layer 532 such as a 30 micron transparent cellulose film.

Figure 10:
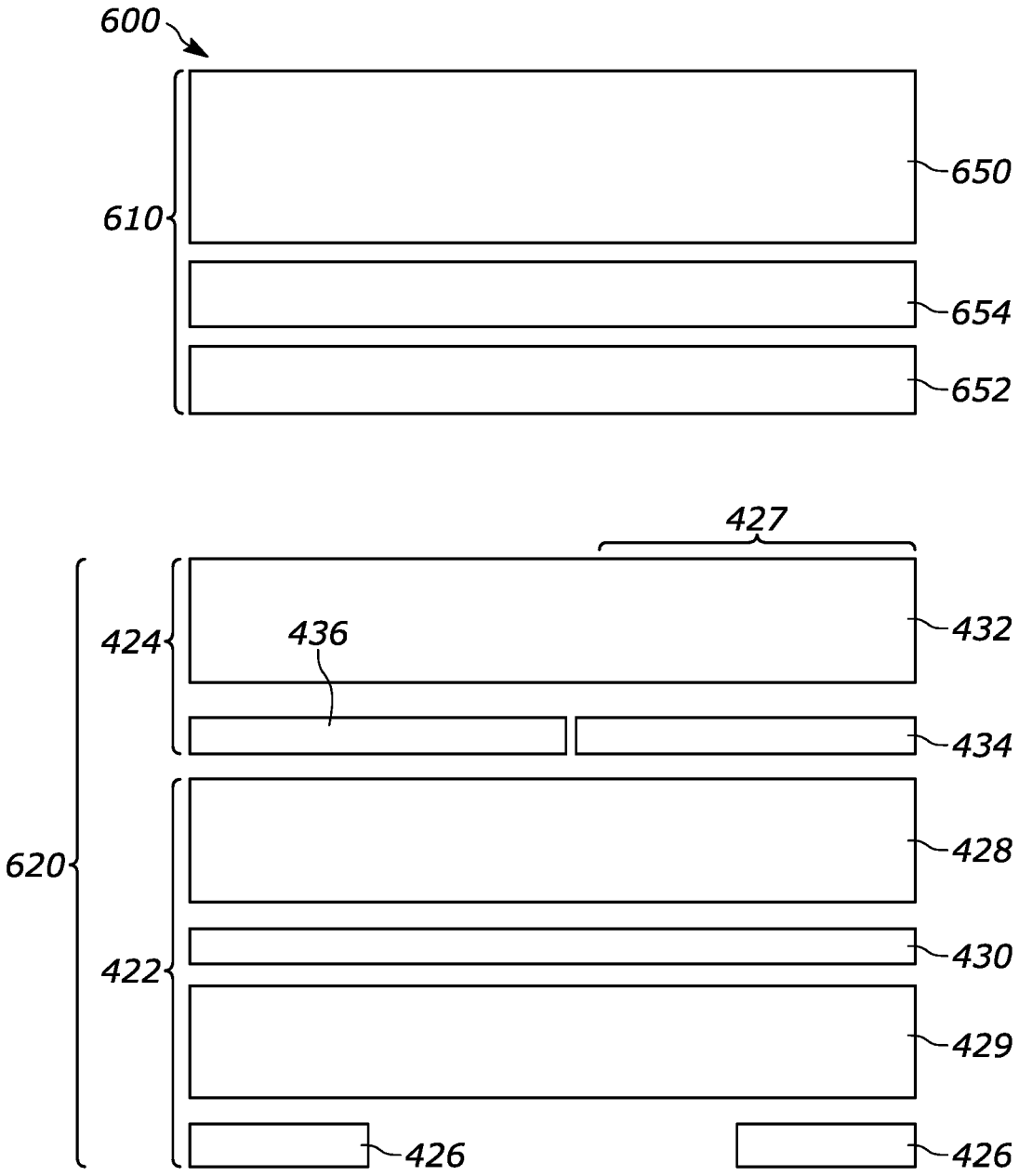
FIG. 10 is a cross-sectional view of a two-part seal having an upper, resealable component and a lower removable seal with a tab.

FIG. 10 shows a two-piece sealing member 600 which includes an upper resealable portion 610 and a lower sealing portion 620. As shown, lower sealing portion 620 is similar to sealing member 420 and includes similar layers and functionality. Upper resealable portion 610 includes a support member 650, such as a 900 micron cardboard. Other materials and thicknesses may be used. Upper resealable portion 610 also includes a film layer 652, such as a 30 micron transparent cellulose material. The film layer 652 is adhered to the support member 650 via a compostable adhesive 654. In use, the upper resealable portion 610 may be adhered to the lower sealing portion 620, such as via a sacrificial layer that ruptures or separates during lid removal. In other forms, the upper resealable portion 610 is not adhered to the lower sealing portion 620, but they are placed adjacent one another in the lid before installation on a container.

In use, the lid may be removed whereby upper resealable portion 610 remains in the lid, exposing the lower sealing portion 620. The lower sealing portion 620 may then be removed from the container. When the lid is then replaced on the container, the upper resealable portion 610 may generally reseal the container. As shown in FIG. 10, the upper resealable portion 610 is also compostable and substantially free of non-compostable materials.

Further specific details regarding the layers of the sealing members will be described in more detail, along with exemplary configurations. Many of the embodiments described herein are generally substantially free of non-compostable plastic materials such that they are readily compostable. By generally free of non-compostable plastic materials, it is meant less than 5 wt. % non-compostable plastic materials. Further, in some forms, nearly all of the layers in the sealing members are completely free of non-compostable plastic materials. In some instances, certain layers, such as the sealant layer, may include some plastic materials. However, the thickness of the sealant layer, as well as the amount of sealant layer that is provided in or otherwise remains in the sealing member after removal is very low relative to the overall combination of materials such that the sealing member is still compostable.

Further, in some forms, such as described below, one or more of the layers may include a metallized coating to provide membrane properties, such as a moisture barrier, air barrier, and the like. However, the metallized coating is a relatively low amount compared to the remainder of the sealing member such that the sealing member is still compostable. In this regard, the sealing members herein are free from metal foil layers. In some forms, the sealing members include no metallic materials and in other forms, the sealing members may include a metallized coating. In either of these forms, the sealing member would still be free from having a metal foil, as would typically be used in induction heated sealing members, and the sealing members are still compostable.

In some forms, the total percentage of non-compostable materials in the sealing member is less than 5 wt. % based on the total weight. In some forms, the total percentage of non-compostable materials in the sealing member is less than 3 wt. % based on the total weight. In some forms, the percentage of a single non-compostable material in the sealing member is less than 1 wt. %. In some forms, the percentage of a single non-compostable material in the sealing member is less than 0.5 wt. %.

The sealant layers used in the sealing members may include a variety of different materials. Typically the sealant layers can be selected for compatibility with the type of containers they are being used with. Many containers include polyethylene, polypropylene, polyethylene terephthalate, poly vinyl chloride, and other materials. Therefore, the sealant material would be selected for compatibility. The sealant material may also be selected such that it is compostable or otherwise used in such a minimal amount relative to the overall sealing member that the sealant layer does not impact compostability. For example, such sealant materials may include but are not limited to polyurethanes and the like. The sealant layer may also be provided in various thicknesses, such as from about 1 to about 10 microns. In some forms, the sealant layer is provided in a thickness from about 2 to about 5 microns. The sealant layer may be compostable and/or non-compostable. When provided in a non-compostable form, it may be desirable to keep the layer thin so as to decrease the amount of non-compostable materials.

Further, the sealant layer 26 may be especially suited to other forms of sealing besides induction sealing since the tabbed sealing member does not include a foil layer. For example, the sealant layer 26 may be configured for ultrasonic sealing, conduction sealing, high frequency sealing, and the like.

The sealant layer may also be provided as a full layer or as a partial layer, such as only being positioned primarily over the land area of the container rim. In some forms, the sealant layer is less than 1 wt. % of the total sealing member. In some forms, the sealant layer is less than 0.5 wt. % of the total sealing member. In some forms, the sealant layer is applied in an amount of about 0.5 to about 10 $g/m^2$. In some forms, the sealant layer is applied in an amount of about 1 to about 5 $g/m^2$.

In some forms, the sealant layer may be configured as a pressure sensitive adhesive. Such pressure sensitive adhesives may include about 0.2 to about a 0.5 mil (or less) adhesive, such as a coated ethylene vinyl acetate (EVA), polyolefins, 2-component polyurethane, ethylene acrylic acid copolymers, curable two-part urethane adhesives, epoxy adhesives, ethylene methacrylate copolymers, and the like bonding materials.

The lower sealant or heat seal layer may be composed of any material suitable for bonding to the rim of a container, such as, but not limited to, induction, conduction, ultrasonic, or direct bonding methods. Suitable adhesives, hot melt adhesives, or sealants for the heat sealable layer include, but are not limited to, polyesters, polyolefins, ethylene vinyl acetate, ethylene-acrylic acid copolymers, surlyn, and other suitable materials. By one approach, the heat sealable layer may be a single layer or a multi-layer structure of such materials about 0.2 to about 10 mils thick. By some approaches, the heat seal layer is selected to have a composition similar to and/or include the same polymer type as the composition of the container. For instance, if the container includes polyethylene, then the heat seal layer would also contain polyethylene. If the container includes polypropylene, then the heat seal layer would also contain polypropylene. Other similar materials and combinations are also possible.

The at least one film layer in the lower laminate portion typically includes compostable materials. The at least one film layer may include materials such as, but not limited to, cellulose, cellulose films, polylactic acid, casein, and the like. Examples of cellulose materials include, but are not limited to Natureflex by Futamusa.

In some forms, the at least one film layer has a thickness of about 20 to about 100 microns. In other forms, the film layer has a thickness of about 30 to about 50 microns. It should be appreciated that even further film layers may be included in the lower laminate such that the overall thickness of the lower laminate may be modified.

As noted above, the sealing member may be provided without any metal foil layers. Metal foil layers typically provide induction heating performance and also barrier properties. In certain instances, it may be desirable to include improved barrier properties. Such barrier properties include, but are not limited to, oxygen barrier, moisture barrier, and the like. However, in some forms it may be desirable to increase these properties without adding a metal foil layer. In such forms, barrier films and/or coatings may be used on one or more of the layers, such as the at least one film layer in the lower laminate portion. Such materials and coatings include, but are not limited to SiOx, AlOx, EVOH, and combinations thereof. In other forms, metal particles, such as aluminum, are vacuum deposited or lightly coated onto one or more layers.

As noted above, the additional layer 30 in the lower laminate may perform a variety of different functions. The additional layer may be positioned and otherwise function as an adhesion promoter and/or sacrificing layer between the film layer in the lower laminate and the sealant layer. The additional layer can be used to provide a controlled break of the bond between the sealant layer and the additional layer and/or the remainder of the sealing member, such as a portion of the land area in the upper laminate portion.

The additional layer may include a variety of different materials such as cellulose, polyvinyl butyral, nitrocellulose, acrylics, polyurethane, co-polyesters, and combinations thereof. The additional layer in the lower laminate may have a variety of different thicknesses, such as from about 0.5 to about 50 microns. In some forms, the additional layer has a thickness of about 0.5 to about 1 micron.

The adhesive layer, such as layers 36 and 236, used between the upper and lower laminate portions may be a variety of different materials, including compostable materials. Such materials include, but are not limited to, polyurethane, acrylics, and the like. Examples include, but are not limited to, MS 255 Eco+CS-95 by Morchem. The adhesive layer may also be used in a variety of thicknesses. For example, the adhesive layer may have a thickness between about 1 to about 10 microns. In some forms, the adhesive layer may have a thickness between about 2 to about 5 microns.

The support layer 32 in the upper laminate portion may also include a variety of different materials and different thicknesses. For example, the support layer may include materials such as cellulose films, polylactic acid, casein, and the like. The support layer may be provided in a variety of different thicknesses. In some forms, the support layer may have a thickness of about 20 to about 50 microns.

The print layer may also include a variety of different materials and thicknesses. In general, the print layer can be applied to another layer, such as in the form of printing. Printing inks may be used including, but not limited to, nitrocellulose, PVD (physical vapor deposition) pigments, acrylic, polyurethane, polyvinylbutyral, (PVB) and the like. In some forms, the print layer is applied to one of the layers in the upper laminate portion. In other forms, the print layer may be applied to a different layer which is then combined with one or more of the other layers. In some forms, the ink may be encapsulated between the films and layers described herein and/or may be encapsulated between additional film layers. In some forms, the ink provided is less than about 1 wt. % of the total sealing member.

In some forms, all of the layers of the sealing member, with the exception of the sealant layer, are compostable. As noted above, the sealant layer may be chosen and positioned such that it makes up a very small percentage of the overall sealing member such that the sealing member is still compostable. Further, the sealant layer may be configured so that it is generally over the land area and may remain on the container, as a remnant, such that the sealant is no longer found on the sealing member after removal from the container. Therefore, the removed sealing member may include only compostable materials.

EXAMPLE 1

Exemplary forms of a compostable sealing member may include a variety of different combinations of layers, materials, and thicknesses. One exemplary combination may include an upper laminate portion having a 45 micron cellulose film that is transparent and functions as support layer 32. A compostable adhesive, such as compostable polyurethane materials (for example, MS 255 Eco+CS-95 by Morchem) can be partially applied across the surface area of the upper laminate portion in an amount of about 4-5 grams per square meter to partially adhere the upper laminate portion to the lower laminate portion. The lower laminate portion includes a 45 micron metallized cellulose film, such as Natureflex by Futamusa having a vacuum deposited metal coating. In the lower laminate portion 3-4 grams per square meter of a compostable adhesive can be used to adhere the metallized cellulose film to a 45 micron cellulose film. Finally, a PET heat seal lacquer, applied at 3 grams per square meter, is positioned as the lowermost layer and functions as the sealant layer in the lower laminate portion.

EXAMPLE 2

In Example 2, a sealing member was generally prepared in accordance with the features shown in FIG. 8. In this form, the following components and amounts were included. The below table also lists the relative amounts of each of the layers to illustrate the overall amount of compostable material.

Compostable structure/Registered coated

| my | gr | | gr compostable | % |
|---|---|---|---|---|
| 45 | 64.5 | Cellulose transp. | 64.5 | |
| 1 | 1 | Inks | | 0.50% |
| 2 | 2 | Adhesive part. (1/2) | 2 | |
| 45 | 64.5 | Cellulose met. | 64.5 | |
| 4 | 4 | Adhesive | 4 | |
| 45 | 64.5 | Cellulose transp. | 64.5 | |
| 1 | 1 | PET heatseal coverage (30%) | | 0.50% |
| 0 | 0 | Others | 0 | |
| | 201.5 | Total (gr) | 199.5 | |

99.01% Compostable material

EXAMPLE 3

In Example 3, similar materials were used as in Example 2, but the thickness of some of the layers were modified. By modifying the thicknesses, the percentage of compostable materials changes.

Compostable structure/Registered coated

| my | gr | | gr compostable | % |
|---|---|---|---|---|
| 30 | 43 | Cellulose transp. | 43 | |
| 1 | 1 | Inks | | 0.74% |
| 2 | 2 | Adhesive part. (1/2) | 2 | |
| 30 | 43 | Cellulose met. | 43 | |
| 4 | 4 | Adhesive | 4 | |
| 30 | 43 | Cellulose transp. | 43 | |
| 1 | 1 | PET heatseal coverage (30%) | | 0.74% |
| 0 | 0 | Others | 0 | |
| | 137 | Total (gr) | 135 | |

98.54% Compostable material

EXAMPLE 4

In Example 4, a similar material was prepared as in Example 2, but the heatseal covered the entire surface area of the seal and not just in the area above the rim when installed on the container. In this form, the amount of PET heatseal increases, which also changes the percentage of compostable materials.

Compostable structure/Full Surface coated

| my | gr | | gr compostable | % |
|---|---|---|---|---|
| 45 | 64.5 | Cellulose transp. | 64.5 | |
| 1 | 1 | Inks | | 0.50% |
| 2 | 2 | Adhesive part. (1/2) | 2 | |
| 45 | 64.5 | Cellulose met. | 64.5 | |
| 4 | 4 | Adhesive | 4 | |
| 45 | 64.5 | Cellulose transp. | 64.5 | |
| 3 | 3 | PET heatseal coverage (100%) | | 1.50% |
| 0 | 0 | Others | 0 | |
| | 203.5 | Total (gr) | 199.5 | |

98.03% Compostable material

EXAMPLE 5

In Example 5, a similar material was prepared as in Example 3, but the heatseal covered the entire surface area of the seal and not just in the area above the rim when installed on the container. In this form, the amount of PET heatseal increases, which also changes the percentage of compostable materials.

Compostable structure/Full Surface coated

| my | gr | | gr compostable | % |
|---|---|---|---|---|
| 30 | 43 | Cellulose transp. | 43 | |
| 1 | 1 | Inks | | 0.74% |
| 2 | 2 | Adhesive part. (1/2) | 2 | |
| 30 | 43 | Cellulose met. | 43 | |
| 4 | 4 | Adhesive | 4 | |
| 30 | 43 | Cellulose transp. | 43 | |
| 3 | 3 | PET heatseal coverage (100%) | | 2.22% |
| 0 | 0 | Others | 0 | |
| | 139 | Total (gr) | 135 | |

97.12% Compostable material

EXAMPLE 6

In Example 6, a two-piece sealing member was prepared similar to that shown in FIG. 10. The upper resealable portion included the board, adhesive, and transparent cellulose film such that the upper resealable portion was compostable.

Compostable structure/Double wad/Full Surface coated

| my | gr | | gr compostable | % |
|---|---|---|---|---|
| 900 | 490 | Board | 490 | |
| 4 | 4 | Adhesive | 4 | |
| 30 | 43 | Cellulose transp. | 43 | |
| 45 | 64.5 | Cellulose transp. | 64.5 | |

-continued

| Compostable structure/Double wad/Full Surface coated | | | | |
|---|---|---|---|---|
| my | gr | | gr compostable | % |
| 1 | 1 | Inks | | 0.14% |
| 2 | 2 | Adhesive part. (1/2) | 2 | |
| 45 | 64.5 | Cellulose met. | 64.5 | |
| 4 | 4 | Adhesive | 4 | |
| 45 | 64.5 | Cellulose transp. | 64.5 | |
| 3 | 3 | PET heatseal coverage (100%) | | 0.41% |
| 0 | 0 | Others | 0 | |
| | 740.5 | Total (gr) | 736.5 | |

99.46% Compostable material

Further general details of the sealing members, tabs, components, and layers are provided below.

In one aspect, the tab may be formed by a full layer or partial layer of material combined with a partial width composite adhesive structure. This partial composite adhesive structure bonds the upper laminate to the lower laminate to form the gripping tab.

In other aspects of this disclosure, the upper laminate of the seal does not extend the full width of the sealing member in order to define the gripping tab. To this end, the pull tab sealing members herein may also combine the advantages of a tabbed sealing member with a large gripping tab defined completely within the perimeter of the seal, but achieve such functionality with less material (in view of the part layers of the upper laminate) and permit such a tab structure to be formed on many different types of pre-formed lower laminates. The partial upper laminate structure is advantageous, in some approaches, for use with a seal configured for large or wide mouth containers, such as containers with an opening from about 30 to about 100 mm (in other approaches, about 60 to about 100 mm). These seals may also be used with 38 mm or 83 mm container openings, or can be used with any sized container.

In further aspects of this disclosure, the sealing members herein may include a pull or grip tab defined in the upper laminate portion wholly within a perimeter or circumference of the sealing member wherein an upper surface of the sealing member is partially defined by the upper laminate portion and partially defined by the lower laminate portion. In one approach of this aspect, the top surface of the sealing member is provided by a minor portion of the upper laminate and a major portion of the lower laminate. In other approaches of this aspect, the lower laminate is partially exposed at a top surface of the seal with about 50 percent to about 75 percent (or more) of the lower laminate exposed at the top surface of the entire seal. The seals of this aspect allow consumers to remove the sealing member using the tab (as in a conventional pull tab seal) and/or puncture the sealing member by piercing the exposed lower laminate portion to provide push/pull functionality depending on the preference of the consumer.

In the various embodiments, the seals of the present disclosure defining a tab wholly within a perimeter or circumference of the seal (formed by a full or partial layer) also provide an improved ability for the tabbed sealing member to function in a two-piece seal and liner combination. In a two-piece seal and liner combination, the tabbed sealing member is temporarily adhered across its top surface to a liner. After container opening and removal of a cap or closure, the sealing member stays adhered to the container mouth and the liner separates and remains in the container's cap.

In some prior versions of two-piece seal and linear assemblies, the bottom layer of the sealing member is a heat seal layer that is activated by heating, such as by induction or conduction heating, in order to adhere or bond an outer periphery of the sealing member to a rim surrounding the mouth of a container. In the two-piece seal and liner combination, an upper surface of the sealing member is temporarily adhered to a lower surface of the liner by a release layer, which is often a heat-activated release layer, such as an intervening wax layer. During heating to bond the sealing member to the container, heat not only activates the lower heat seal layer, but also travels upwardly through the seal to melt the intervening wax across the entire surface of the sealing member to separate the liner from the sealing member. Often, the melted wax is absorbed by the liner in order to permit easy liner separation from the sealing member. As can be appreciated, for this sealing member and liner combination to function properly, the intervening wax layer needs to be melted across the entire surface of the sealing member. If the wax is not melted evenly all the way across the sealing member upper surface, the liner may not properly separate from the lower seal portion.

The various layers of the sealing member may be assembled via coating adhesives, applying films, and/or a heat lamination process forming a sheet of the described layers. Extrusion lamination may also be used. The resulting laminate sheet of the sealing members can be cut into appropriate sized disks or other shapes as needed to form a vessel closing assembly or tabbed sealing member. The cut sealing member is inserted into a cap or other closure which, in turn, is applied to the neck of a container to be sealed. The screw cap can be screwed onto the open neck of the container, thus sandwiching the sealing member between the open neck of the container and the top of the cap. The sealing layer may be a pressure sensitive adhesive, the force of attaching the closure to the container can activate the adhesive.

Figure 11:
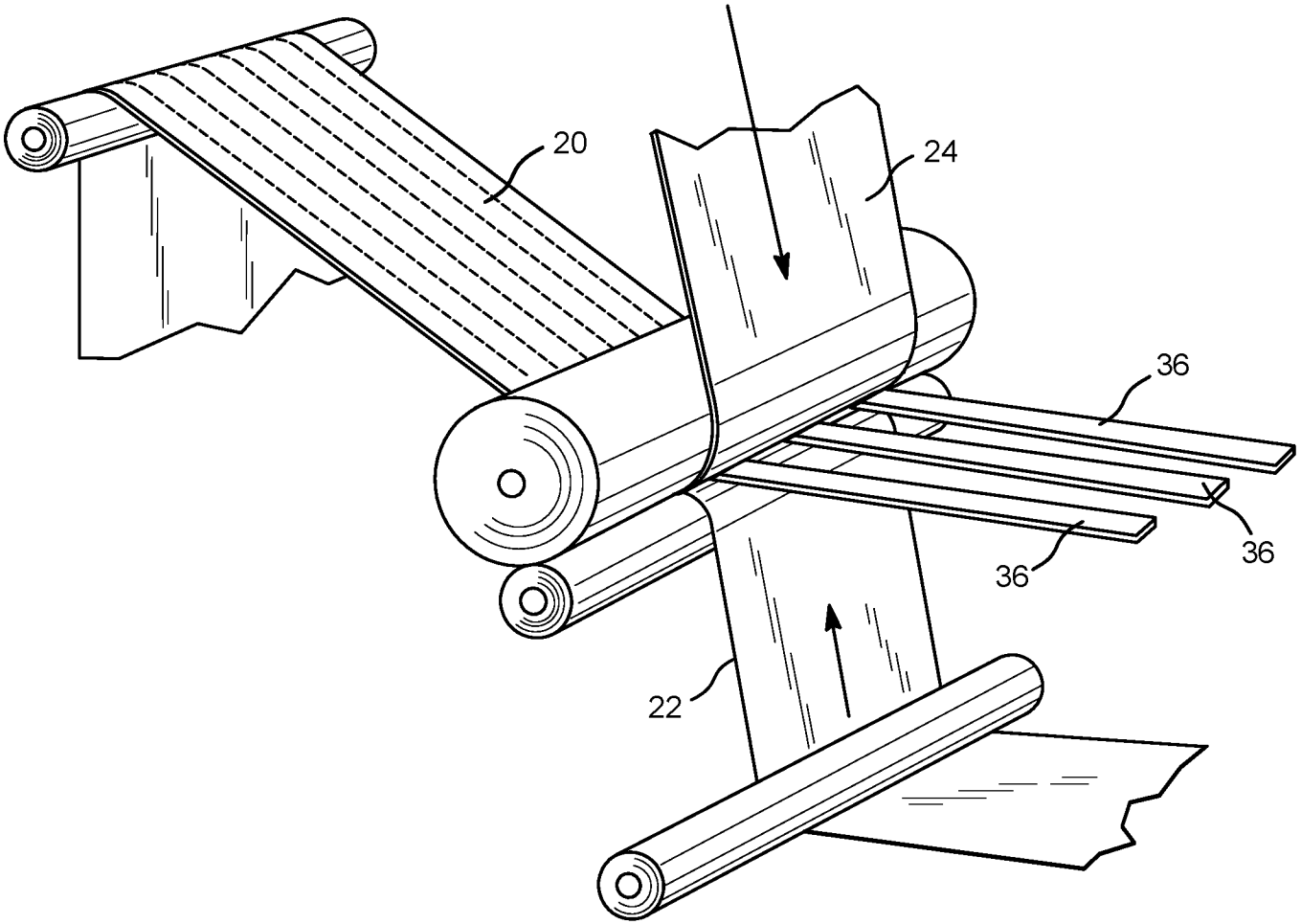
FIG. 11 is a perspective view of one form of assembling a laminate used to form a tabbed sealing member.

One form of assembling tabbed sealing members is shown in FIG. 11. In this form, the upper laminate portion 24 is joined to the lower laminate portion 22 with the adhesive layer 34 therebetween. It should be appreciated that a release layer can also or alternatively be positioned therebetween. In some forms, the upper laminate portion can be pre-formed, such as using higher density, higher melting point materials adhered to one another in a separate bonding process. This pre-formed material can then be adhered to the lower laminate portion using a heat lamination process using heated rollers and/or using a separate adhesive.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A compostable sealing member for sealing to a rim surrounding a container opening, the compostable sealing member comprising:

a multi-layer laminate including an upper laminate portion bonded to a lower laminate portion, the lower laminate portion positioned below the upper laminate portion and including at least one film layer and a sealant layer for bonding to the container rim, the upper laminate portion being bonded to the lower laminate portion through a partial layer of compostable adhesive to form a gripping tab for removing the sealing member from the container opening, the upper laminate portion including a support layer, and the compostable sealing member being substantially free of plastic materials.

2. The compostable sealing member of claim 1 wherein the sealing member contains less than 5 wt. % non-compostable plastic materials.

3. The compostable sealing member of claim 1 wherein the sealing member contains less than 3 wt. % non-compostable materials.

4. The compostable sealing member of claim 1 wherein the sealing member contains less than 1 wt. % of a single non-compostable material.

5. The compostable sealing member of claim 1 wherein the sealing member is free of metal foil.

6. The compostable sealing member of claim 1 wherein the at least one film layer comprises at least one of cellulose, compostable adhesive, and combinations thereof.

7. The compostable sealing member of claim 1 wherein, the compostable adhesive comprises one or more compostable polyurethanes.

8. The compostable sealing member of claim 1 wherein the lower laminate portion further includes a sacrificial layer between the at least one film layer and the sealant layer.

9. The compostable sealing member of claim 8 wherein at least one of the sealant layer and the sacrificial layer is primarily positioned over the rim area when installed on the container.

10. The compostable sealing member of claim 1 wherein the gripping tab is defined wholly within a perimeter of the sealing member without extending substantially beyond the rim of the container.

11. The compostable sealing member of claim 1 wherein the gripping tab extends external to the rim when installed on the container.

12. The compostable sealing member of claim 1 wherein the sealant layer is a pressure sensitive adhesive.

13. The compostable sealing member of claim 1 wherein the upper laminate portion includes a print layer.

14. The compostable sealing member of claim 1 further comprising a sacrificial layer between the at least one film layer and the sealant layer, wherein the sacrificial layer ruptures and/or releases from at least one of the sealant layer and the at least one film layer to leave a remnant portion on the rim when the compostable sealing member is removed from the rim.

15. A laminate for forming a compostable sealing member, the laminate comprising:

an upper laminate portion including a support layer; and a lower laminate portion including at least one film layer and a sealant layer for bonding to the container rim, the upper laminate portion bonded to a lower laminate portion, the upper laminate portion being bonded to the lower laminate portion through a partial layer of compostable adhesive to form a gripping tab for removing the sealing member from the container opening, the laminate being substantially free of plastic materials.

16. A compostable sealing member for sealing to a rim surrounding a container opening, the compostable sealing member comprising:

a multi-layer laminate including an upper laminate portion bonded to a lower laminate portion, the lower laminate portion positioned below the upper laminate portion and including at least one film layer and a sealant layer for bonding to the container rim, the sealant layer being a partial layer that is positioned above the rim when installed on the container opening, the upper laminate portion being bonded to the lower laminate portion through a partial layer of compostable adhesive to form a gripping tab for removing the sealing member from the container opening, the upper laminate portion including a support layer, and the compostable sealing member being substantially free of plastic materials.

17. A compostable sealing member for sealing to a rim surrounding a container opening, the compostable sealing member comprising:

a multi-layer laminate including an upper laminate portion bonded to a lower laminate portion, the lower laminate portion positioned below the upper laminate portion and including at least one film layer, a sealant layer for bonding to the container rim, the upper laminate portion including a support layer, the upper laminate portion being bonded to the lower laminate portion through a partial layer of compostable adhesive to form a gripping tab for removing the sealing member from the container opening, a partial print layer that is positioned such that the compostable adhesive and partial print layer do not overlap, and the compostable sealing member being substantially free of plastic materials.

* * * * *